US006254691B1

(12) United States Patent
Campbell

(10) Patent No.: US 6,254,691 B1
(45) Date of Patent: Jul. 3, 2001

(54) FEATHER DUSTER AND DUSTING METHOD

(75) Inventor: Jeff Campbell, Ioue, CA (US)

(73) Assignee: Harper Corporation, Arlington, TX (US)

( * ) Notice: Subject to any disclaimer, the term of this patent is extended or adjusted under 35 U.S.C. 154(b) by 0 days.

(21) Appl. No.: 09/412,696

(22) Filed: Oct. 5, 1999

(51) Int. Cl.[7] ..... A47L 13/38
(52) U.S. Cl. ..... 134/6; 15/234; D32/51
(58) Field of Search ..... 15/234; D32/35, D32/40, 51, 52; 134/6

(56) References Cited

U.S. PATENT DOCUMENTS

| | | | | |
|---|---|---|---|---|
| 35,529 | * | 6/1862 | McConnell | D32/51 |
| 144,728 | * | 11/1873 | Baker | 15/234 |
| 158,412 | * | 1/1875 | Griswold | 15/234 |
| 226,601 | | 4/1880 | Davis | 15/234 |
| 227,837 | | 5/1880 | Richmond | 15/234 |
| 271,877 | | 2/1883 | Little | 15/234 |
| 385,070 | * | 6/1888 | Richmond | 15/234 |
| 442,433 | | 12/1890 | Hair | 15/234 |
| 698,880 | | 4/1902 | Warren et al. | 15/234 |
| 954,354 | | 4/1910 | Smith | 15/234 |
| 3,162,880 | * | 12/1964 | Francis | 15/234 |
| 4,031,588 | | 6/1977 | Leroy et al. | 15/171 |

* cited by examiner

*Primary Examiner*—Mark Spisich
(74) *Attorney, Agent, or Firm*—Haynes and Boone, LLP

(57) ABSTRACT

A feather duster and dusting method according to which the respective end portions of a plurality of curved feathers are attached to a handle and the feathers are oriented so that the other end portions of the feathers curve radially outwardly from the axis of the handle in one general direction.

11 Claims, 3 Drawing Sheets

FEATHER DUSTER AND DUSTING METHOD

BACKGROUND

The present disclosure relates, in general, to a feather duster, and a dusting method, and, more particularly, to a duster that provides improved dust removal from a surface to be dusted.

Feather dusters are well known and used primarily to remove dust from a surface. A typical feather duster has a plurality of feathers secured to, and extending from an elongated handle. Each feather has flue, consisting of a multitude of barbs and barbules extending from a quill. The feathers, and, more specifically the quills, have a slight natural bend, or curvature, and the quills are usually arranged so that their natural curvatures result in their distal end portions extending radially outwardly and being angularly spaced for 360 degrees, so that the cross section of the duster at the distal ends of the feathers forms a complete circle.

However, these type of arrangements suffer from two major problems. More particularly, the surface to be dusted is contacted, for the most part, by only the end portion of each feather. Therefore, the remaining portion of each of the feathers is not utilized. Also, during the dusting of a horizontal surface, the quills of the feathers tend to compress, creating a spring load effect so that, at the end of the dusting stroke, the quills spring back their normal position and flip the dust up in the air which returns to the surface being dusted, thus rendering the operation very inefficient. Further, if a side of the duster is used so that the feathers on the latter side engage the surface along their lengths, only a few of the feathers are utilized since a good portion of the remaining feathers are located diametrically opposite the feathers that are used.

Accordingly, what is needed is a feather duster that permits a relative large number of feathers to be used while engaging the surface to be dusted along their lengths. Also needed is a feather duster that insures that the dust from the surface is directed down away from the surface so that it will not return to the surface.

SUMMARY

To this end, a feather duster and dusting method are provided according to which the respective end portions of a plurality of curved feathers are attached to a handle. The feathers are oriented so that the other end portions of the feathers curve radially outwardly from the axis of the handle in one general direction.

Significant advantages are achieved with the above since the feathers contact the surface to be dusted along their entire lengths. Also, when the edge of a horizontal surface is reached, the dust is directed down and away from the surface.

DETAILED DESCRIPTION OF THE PREFERRED EMBODIMENT

Figure 1:
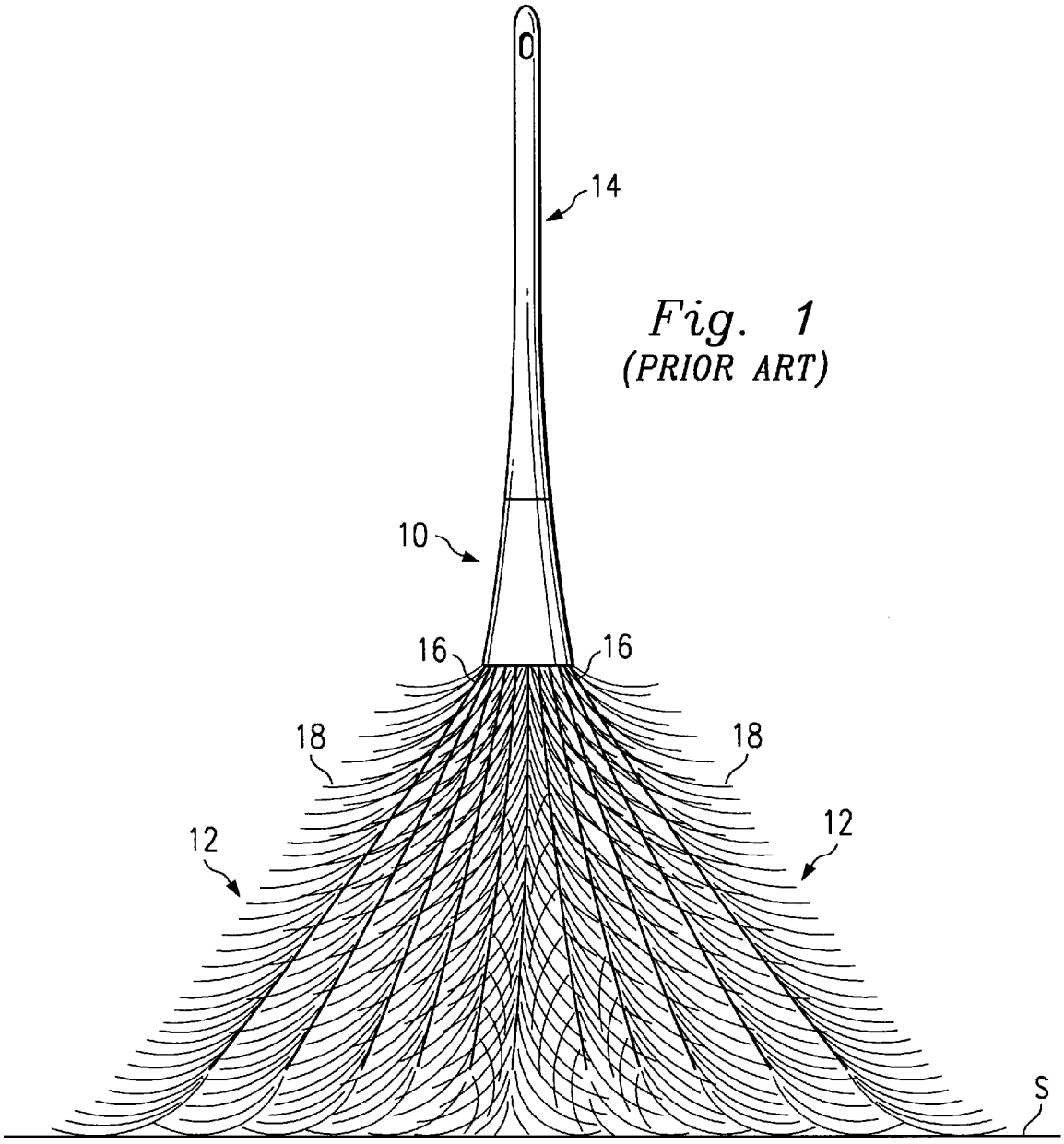
Fig. 1 (PRIOR ART)
FIG. 1 is an elevational view of a typical feather duster according to the prior art.

A typical feather duster according to the prior art is shown, in general, by the reference numeral 10 in FIG. 1 and includes a plurality of feathers 12 extending from a handle 14. Each feather 12 consists of a quill 16 having a plurality of barbs and barbules of flue, collectively referred to by the reference numeral 18, extending therefrom. The quills 16 are oriented so that their slight natural curvatures result in their distal end portions extending radially outwardly. Also, these distal end portions of the quills 16 are angularly spaced for approximately 360 degrees so that the distal ends of the quills circumscribe a complete circle. However, when the duster 10 is oriented relative to a surface S to be dusted as shown in FIG. 1, only the distal ends of the feathers 12 engage the surface S thus causing the problems noted above.

Figure 2:
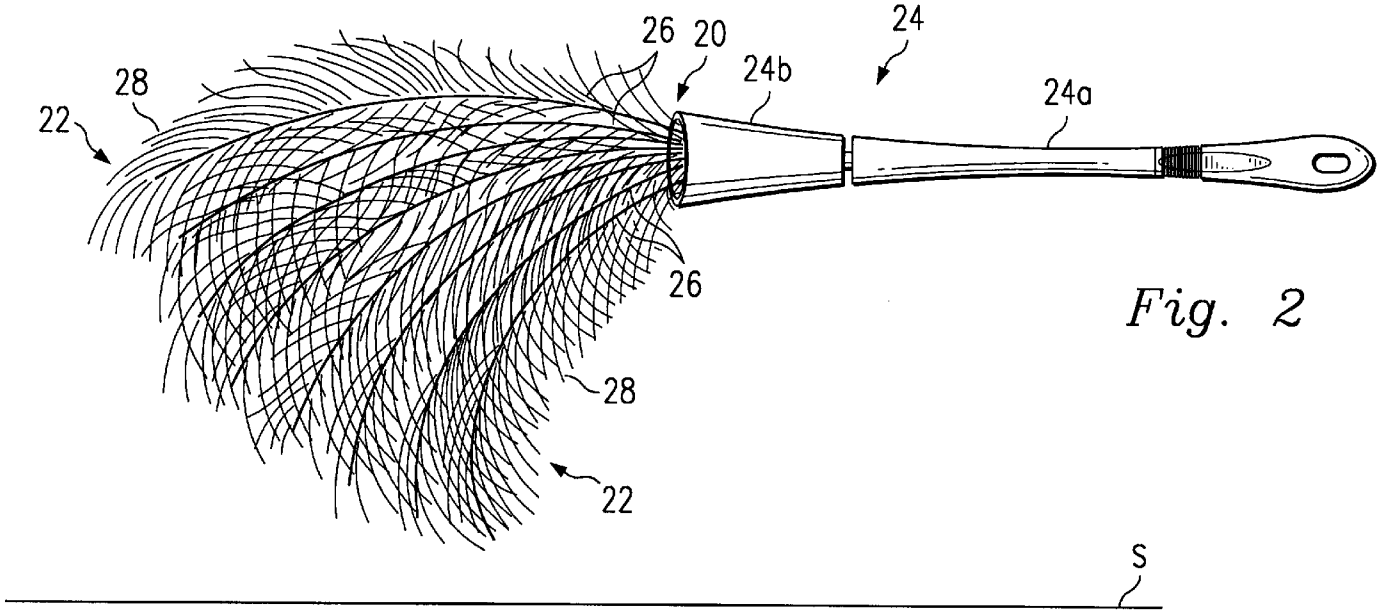
FIG. 2 is an elevational view of a feather duster according to an embodiment of the present invention.
Figure 3:
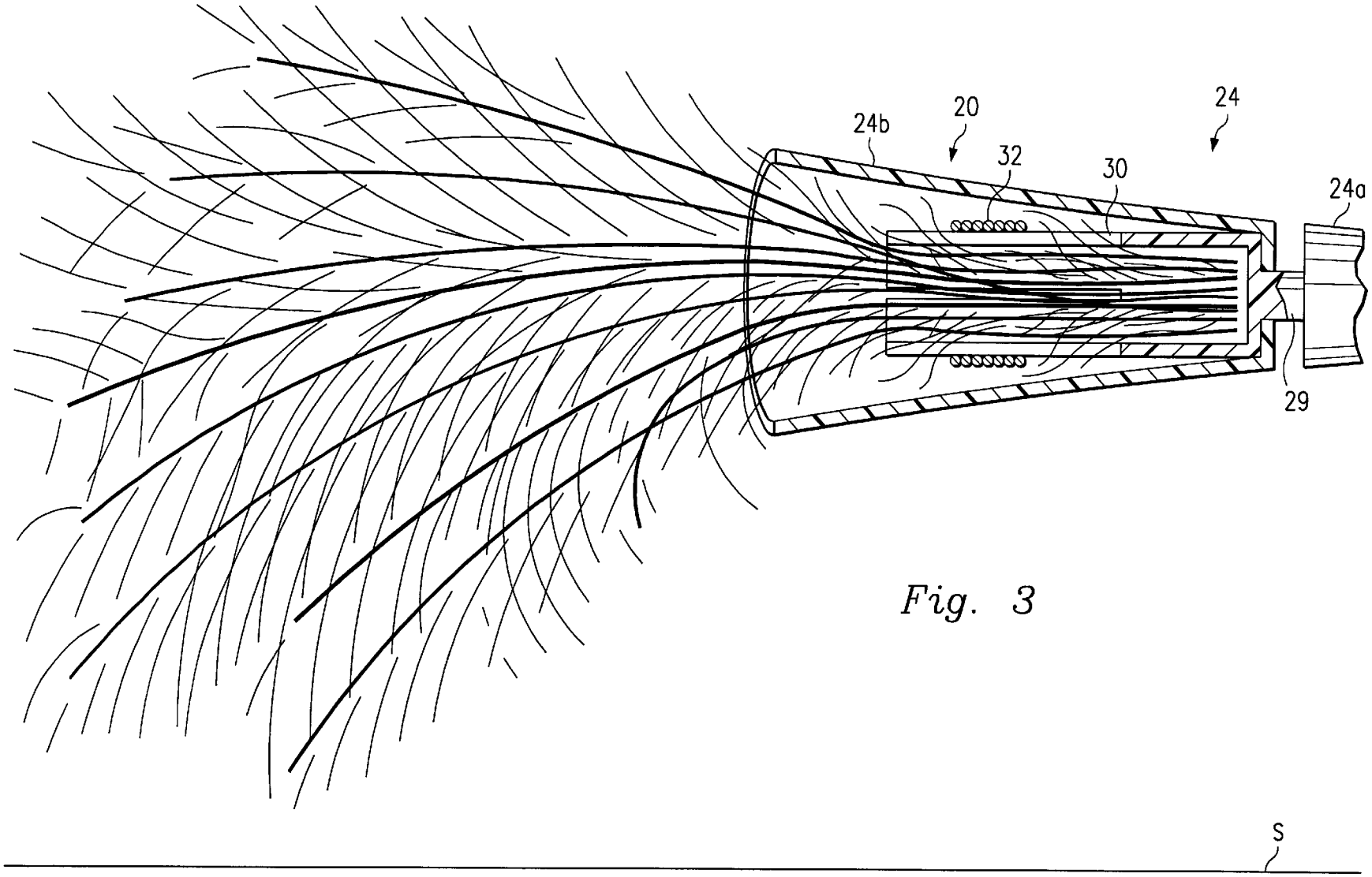
FIG. 3 is an enlarged cross-sectional view taken along the line 3—3 of FIG. 2.

The feather duster according to an embodiment of the present invention is shown by the reference numeral 20 in FIGS. 2 and 3. The duster 20 includes a plurality of feathers 22 extending from a handle 24. Each feather 22 consists of a quill 26 having flue, consisting of a plurality of barbs and barbules, collectively referred to by the reference numeral 28, extending therefrom.

The handle 24 has a grip portion 24*a* (FIG. 2) designed to be gripped by a user, and a support portion 24*b* extending from the grip portion 24*a* for supporting the feathers 22. As shown in FIG. 3, the portions 24*a* and 24*b* are connected by a relatively small-diameter rod 29, and the handle portion 24*b* flares outwardly from the rod and contains a support cylinder 30 which is secured in the latter handle portion in any known manner. One end portion of each feather 22 is disposed in the cylinder 30 so that the latter end portions of the feathers extend in substantially a parallel relationship. A wire 32 is wrapped around the cylinder 30 to clamp the cylinder over the latter end portions of the feathers 22 and secure the feathers in the cylinder and therefore to the handle 24.

According to a feature of the invention, the feathers 22 are oriented so that the natural curvatures of their respective quills extend radially outwardly in one general direction, which is downwardly as viewed in FIGS. 2 and 3. Also, the weight of the upper feathers 22, as viewed in FIG. 2, or the feathers further away from the surface S act on the lower feathers, or the feathers closer to the surface, thus increasing the curvature of the corresponding quills 26 of the lower feathers.

Figure 4:
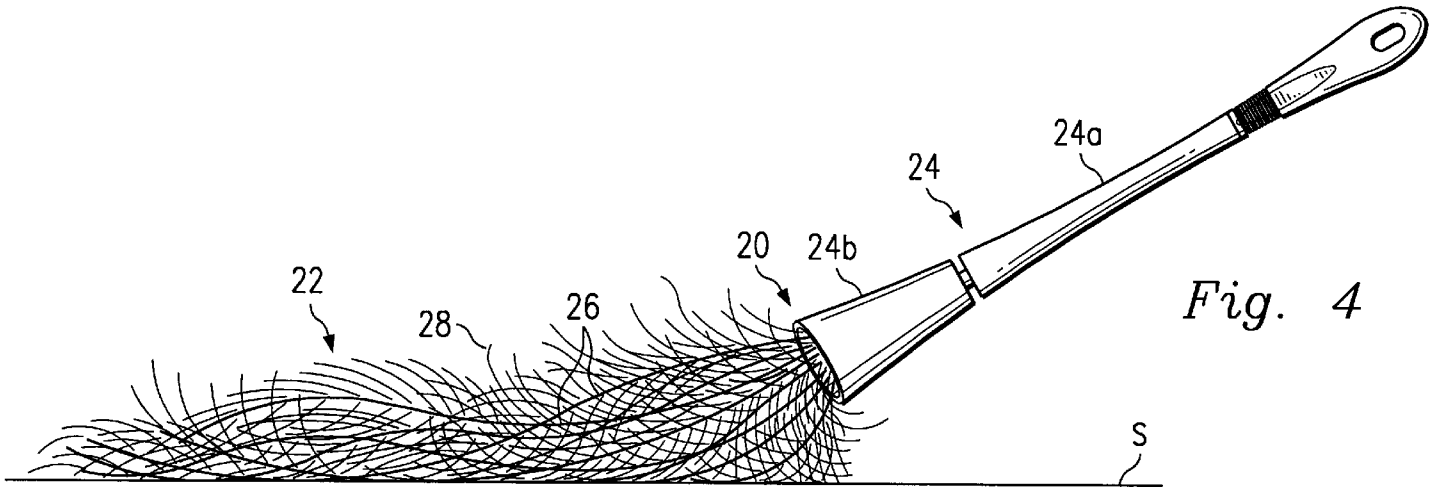
FIG. 4 is a view similar to FIG. 2 but depicting the duster during a dusting operation.

To dust the surface S the duster 20 is placed over the surface S in a spaced parallel relation to the surface as shown in FIG. 2 and is then rotated about the axis of the handle 24 so that at least a majority of the feathers 22 extend downwardly toward the surface S as shown in FIG. 2. The duster 20 is then pressed downwardly towards the surface S which tends to bend the feathers 22 against their curvature to a more straight position extending substantially parallel to the surface, as shown in FIG. 4. The feathers 22 are then swept along the surface to gather the dust in the flue 28. Assuming that the surface S is horizontal, when an edge of it is reached, some of the dust then falls downwardly, by gravity, away from the surface and to the floor. The feathers 22 then spring back to their normal curved portions which tends to propel any dust that is gathered on the surfaces of the barbs and barbules downwardly towards the floor.

Advantages result from the above. For example, a large number of the feathers 22 are utilized. Further, a relative large number of the feathers 22 engage the surface S for the entire lengths of the portions thereof extending from the handle. Also, when the distal end portions of the quills 26 are compressed radially inwardly during the dusting process as described above, a spring load effect is created. Thus, when the duster 10 is moved away from the surface S or reaches an end of the surface, the quills will spring back to their normal position. This results in a further advantage since this movement will assist in the dusting process by propelling the dust downwardly away from a horizontal surface.

It is understood that variations may be made in the foregoing without departing from the scope of the invention. For example, the spatial references, such as "downward", "upper", "lower", "radial", "angular" are for the purpose of illustration only and do not limit the specific orientation or location of the structure described above. Also, the present invention is not limited to the specific handle disclosed above, but is equally applicable to other handle designs.

Since other modifications, changes, and substitutions are intended in the foregoing disclosure, it is appropriate that the appended claims be construed broadly and in a manner consistent with the scope of the invention.

What is claimed is:

1. A duster comprising an elongated handle, and a plurality of curved feathers each having one end portion secured to an end of the handle and generally aligned with the axis of the handle, the feathers being arranged so that their other end portions curve radially outwardly from the axis of the handle in one general direction.

2. The duster of claim 1 wherein the feathers are adapted to engage the surface to be dusted along their lengths.

3. The duster of claim 2 wherein each feather comprises a quill and flue consisting of a plurality of barbs and barbules extending from the quill and wherein, when the feathers engage the surface and are swept along the surface, dust is gathered on the flue.

4. The duster of claim 3 wherein each quill has a natural curvature and wherein the weight of the feathers that are further spaced from the surface increase the curvature of the feathers that are closer to the surface.

5. The duster of claim 2 wherein each feather tends to bend against its curvature when engaging the surface.

6. The duster of claim 5 wherein when an edge of a horizontal surface is reached, some of the dust then falls downwardly, by gravity, away from the surface and the feathers spring back to their normal curved shape which tends to propel any dust that is gathered thereon downwardly away from the surface.

7. A dusting method comprising the steps of:

providing a duster comprising an elongated handle, and a plurality of curved feathers each having one end portion secured to an end of the handle and generally aligned with the axis of the handle, the feathers being arranged so that their other end portions curve radially outwardly from the axis of the handle in one general direction: and applying the feathers to a surface to be dusted so that the surface is contacted by at least a portion of the feathers along their respective lengths.

8. The method of claim 7 where, during the step of applying, the feathers engage the surface and are then swept along the surface to gather dust in a flue of the feathers.

9. The method of claim 8 wherein the quill of each feather has a natural curvature and wherein the weight of the feathers that are further spaced from the surface increase the curvature of the feathers that are closer to the surface.

10. The method of claim 9 wherein each feather tends to bend against its curvature when engaging the surface.

11. The method of claim 10 wherein, when an edge of a horizontal surface is reached, some of the dust falls downwardly, by gravity, away from the surface and the feathers spring back to their normal curved shape which tends to propel any dust that is gathered thereon downwardly away from the surface.

* * * * *